United States Patent [19]

Iida et al.

[11] Patent Number: 4,871,304

[45] Date of Patent: Oct. 3, 1989

[54] AXIAL FLOW FLUID COMPRESSER

[75] Inventors: Toshikatsu Iida, Yokohama; Takayoshi Fujiwara, Kawasaki, both of Japan

[73] Assignee: Kabushiki Kaisha Toshiba, Kawasaki, Japan

[21] Appl. No.: 217,883

[22] Filed: Jul. 11, 1988

[30] Foreign Application Priority Data

Jul. 31, 1987 [JP] Japan ..... 62-191564
Jul. 31, 1987 [JP] Japan ..... 62-191565

[51] Int. Cl.[4] ..... F04B 39/02
[52] U.S. Cl. ..... 418/220; 417/356
[58] Field of Search ..... 418/220; 417/354, 356; 415/71, 72, 73

[56] References Cited

U.S. PATENT DOCUMENTS

| | | | |
|---|---|---|---|
| 1,295,068 | 2/1919 | Rolkerr | 418/220 |
| 2,401,189 | 5/1944 | Quiroz | 418/220 |
| 3,719,436 | 3/1973 | McFarlin | 417/356 |

*Primary Examiner*—Carlton R. Croyle
*Assistant Examiner*—D. Scheuermann
*Attorney, Agent, or Firm*—Cushman, Darby & Cushman

[57] ABSTRACT

A compressor includes a cylinder, and a rotating body located in the cylinder. A spiral groove is formed on the outer periphery of the rotating body. A spiral blade is fitted in the groove and divides the space between the inner periphery of the cylinder and the outer periphery of the rotating body into operating chambers which have volumes gradually decreasing with distance from one end of the cylinder. When the cylinder and rotating body are relatively rotated, a fluid, introduced into the one end of the cylinder, is transported toward the other end of the cylinder through the operating chambers.

17 Claims, 4 Drawing Sheets

AXIAL FLOW FLUID COMPRESSER

BACKGROUND OF THE INVENTION

1. Field of the Invention

The present invention relates to a fluid compressor, and more particularly, to a compressor for compressing refrigerant gas in a refrigerating cycle, for example.

2. Description of the Related Art

Conventionally known are various compressors, including reciprocating compressors, rotary compressors, etc. In these compressors, however, the compression section and driving parts, such as a crankshaft for transmitting a rotatory force to the compression section, are complicated in construction, i.e. with many components being used in their construction. For higher compression efficiency, moreover, these conventional compressors should be provided with a check valve on the discharge side thereof. However, the difference in pressure between two opposite sides of the check valve is so great that gas is liable to leak from the valve. Thus, the compression efficiency cannot be high enough. In order to solve these problems, both dimensional and assembling accuracies of the individual parts or components must be improved, which entails an increase in manufacturing costs.

A screw pump is disclosed in U.S. Pat. No. 2,401,189. In this prior art pump, a columnar rotating body, which has a spiral groove on its outer peripheral surface, is disposed in a sleeve. A spiral blade is slidably fitted in the groove. As the rotating body is rotated, a fluid, confined between two adjacent turns of the blade in the space between the outer peripheral surface of the rotating body and the inner peripheral surface of the sleeve, is transported from one end of the sleeve to the other.

Thus, the screw pump serves only to transport the fluid, and is not adapted to compress it. During the transportation, the fluid can be sealed only if the outer peripheral surface of the blade is continually in contact with the inner peripheral surface of the sleeve. While the rotating body is rotating, however, the blade cannot easily slide smoothly in the groove, due to its susceptibility to deformation. It is difficult, therefore, to continually keep the outer peripheral surface of the blade intimately in contact with the inner peripheral surface of the sleeve. Thus, the fluid cannot be satisfactorily sealed. In consequence, the screw pump of this construction cannot produce any compression effect.

SUMMARY OF THE INVENTION

The present invention has been contrived in consideration of these circumstances, and its object is to provide a fluid compressor, having a relatively simple construction for improved sealing performance and high-efficiency compression, and permitting easier manufacturing and assembling of components.

In order to achieve the above object, a compressor according to the present invention comprises: a cylinder having a suction-side end and a discharge-side end; a columnar rotating body located in the cylinder so as to extend along the axial direction thereof and be eccentric thereto, and rotatable relative to the cylinder in a manner such that part of the rotating body is in contact with the inner peripheral surface of the cylinder, the rotating body having a spiral groove on the outer peripheral surface thereof, the groove having pitches narrowed gradually with distance from the suction-side end of the cylinder; a spiral blade fitted in the groove so as to be slidable, substantially in the radial direction of the rotating body, having an outer peripheral surface intimately in contact with the inner peripheral surface of the cylinder, and dividing the space between the inner peripheral surface of the cylinder and the outer peripheral surface of the rotating body into a plurality of operating chambers having volumes gradually decreasing with the distance from the suction-side end of the cylinder; and drive means for relatively rotating the cylinder and the rotating body, thereby introducing a fluid from the suction-side end of the cylinder into the cylinder, and transporting this fluid toward the discharge-side end of the cylinder through the operating chambers.

BRIEF DESCRIPTION OF THE DRAWINGS

FIGS. 1 to 7D show a fluid compressor according to an embodiment of the present invention, in which FIG. 1 is a sectional view showing an outline of the compressor, FIG. 2 is a side view of a rotating rod, FIG. 3 is a side view of a blade, FIG. 4 is a cutaway side view of the compressor portion, FIG. 5 is a sectional view taken along line V—V of FIG. 4, FIGS. 6A to 6D are diagrams showing compression processes for refrigerant gas, and FIGS. 7A to 7D are sectional views showing the relationship between a drive rod and a groove in different operating states of the compressor.

DETAILED DESCRIPTION OF THE PREFERRED EMBODIMENTS

Preferred embodiments of the present invention will now be described in detail with reference to the accompanying drawings.

Figure 1:
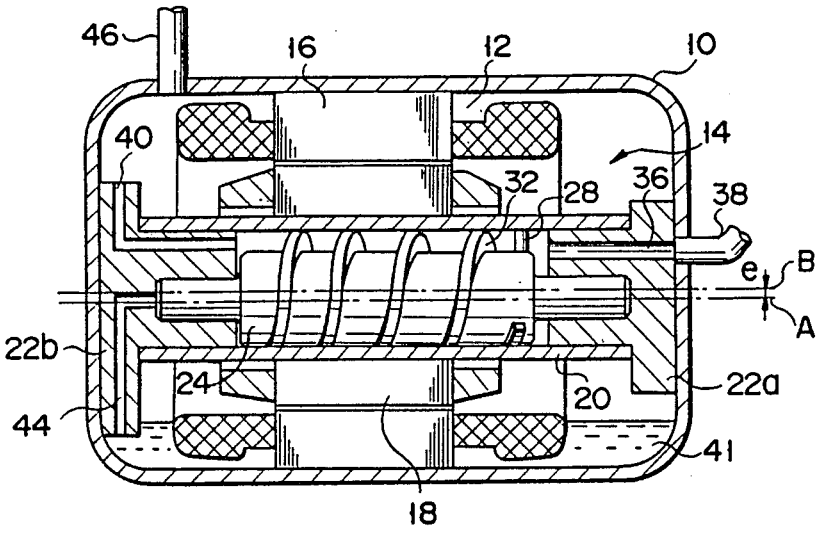
Figure 2:
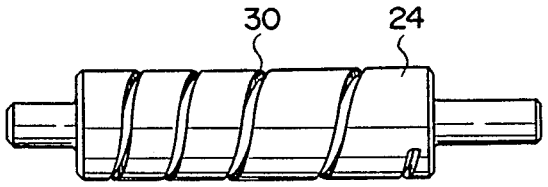
Figure 3:
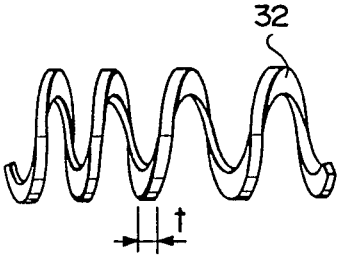

FIG. 1 shows an embodiment according to which the present invention is applied to a compressor for compressing a refrigerant of a refrigeration cycle.

The compressor comprises closed case 10, electric motor section 12, and compression section 14, sections 12 and 14 being located in the case. Motor section 12 includes substantially ring-shaped stator 16 fixed to the inner surface of case 10 and ring-shaped rotor 18 located inside the stator.

Figure 4:
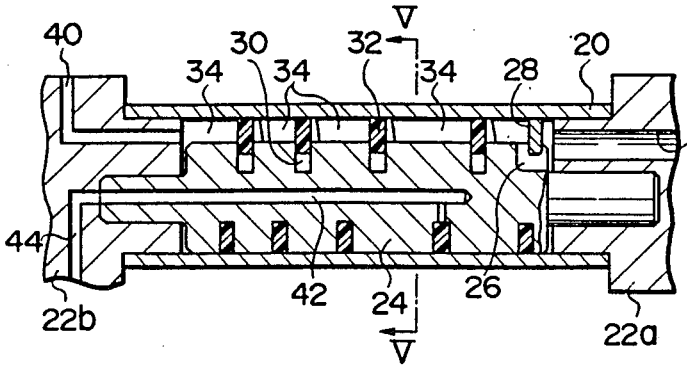
Figure 5:
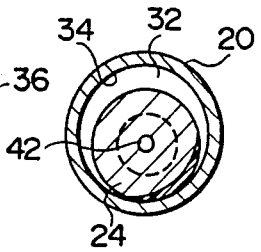
Figure 7A:
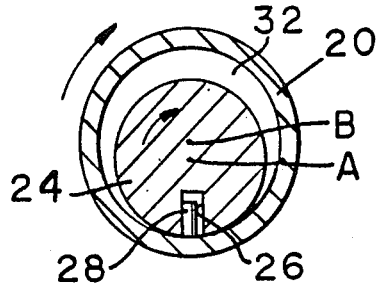
Figure 7B:
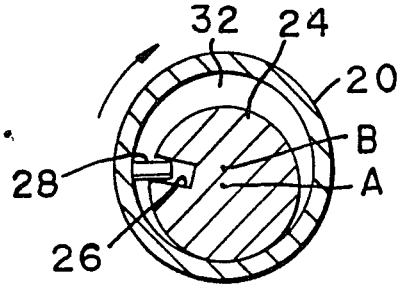
Figure 7C:
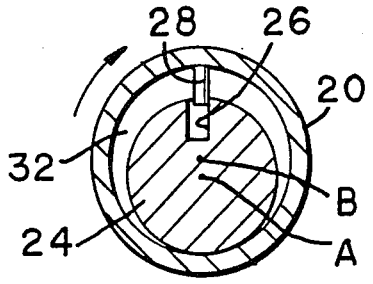
Figure 7D:
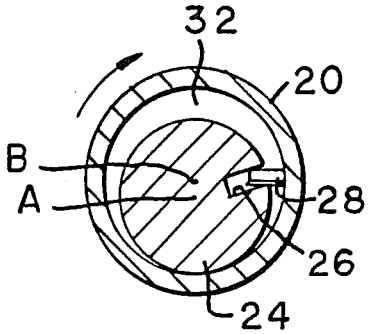

Compression section 14 includes cylinder 20, and rotor 18 is coaxially fixed to the outer peripheral surface of the cylinder. Both ends of cylinder 20 are closed and rotatably supported by means of their corresponding bearings **22*a* and 22*b* which are fixed to the inner surface of case 10. Columnar rotating rod 24, having its diameter smaller than the inner diameter of cylinder 20, is contained in the cylinder so as to extend along the axis thereof. Central axis A of rod 24 is situated at eccentricity e from central axis B of cylinder 20. Part of the outer peripheral surface of rod 24 is in contact with the inner peripheral surface of cylinder 20. Both end portions of rod 24 are rotatably supported by bearings 22*a* and 22*b*, respectively. As is shown in FIGS. 1, 4, and 7A engaging groove 26 is formed o the outer peripheral surface of the right end portion of rod 24. Drive pin 28, which protrudes from the inner peripheral surface of cylinder 20, is fitted in groove 26 so as to be movable in the radial direction of the cylinder. Thus, as shown in FIGS. 7A to 7D, when electric motor section 12 is energized to rotate cylinder 20 integral with rotor 18, the rotatory force of the cylinder is transmitted to rod 24 and extends in the axial direction of the rod. Groove 26 has a rectangular cross section with a width larger than the diameter of drive pin 28. As a result, rod 24 is rotated within cylinder 20** while the outer peripheral surface thereof is partially in contact with the inner surface of the cylinder.

As is shown in FIGS. 1 to 5, spiral groove 30, extending between the two opposite ends of rotating rod 24, is formed on the outer peripheral surface of the rod. As is seen from FIG. 2, groove 30, within which spiral blade 32 is fitted, is formed so that its pitches gradually become narrower with distance from the righthand end of cylinder 20, that is, with distance from the suction side of the cylinder. Thickness t of blade 32 is substantially equivalent to the width of groove 30, and each portion of the blade is movable in the radial direction of rod 24 along the groove. The outer peripheral surface of blade 32 slides on the inner peripheral surface of cylinder 20 intimately in contact therewith. Blade 32 is formed of an elastic material, such as Teflon (Trademark), and can be fitted into groove 30 by utilizing its elasticity.

The space between the inner peripheral surface of cylinder 20 and the outer peripheral surface of rod 24 is divided into a plurality of operating chambers 34 by means of blade 32. Each chamber 34, which is defined between each two adjacent turns of blade 32, is substantially in the form of a crescent extending along the blade from a contact portion between rod 24 and the inner peripheral surface of cylinder 20 to the next contact portion. The capacities of operating chambers 34 are reduced gradually with distance from the suction side of cylinder 20.

As is shown in FIGS. 1 and 4, bearing 22*a* is penetrated by suction hole 36 which extends in the axial direction of cylinder 20. One end of hole 36 opens into cylinder 20, and the other end thereof is connected to suction tube 38 of the refrigeration cycle. Bearing 22*b* is formed with discharge hole 40. One end of hole 40 opens into the discharge-side end of cylinder 20, while the other end thereof opens into the inside space of case 10. Inside rod 24, pressure introduction passage 42 extends close to the right end of the rod from the left end thereof, along the central axis of the rod. The left end of passage 42 communicates with the inside of case 10, especially the bottom portion thereof, by means of passage 44 which is formed in bearing 22*b*. The right end of passage 42 opens to the bottom of groove 30 on rod 24. Lubricating oil 41 is stored at the bottom of case 10. Thus, as the pressure inside case 10 increases, oil 41 is introduced through passages 44 and 42 into the space between blade 32 and the bottom of groove 30. Pressure introduction passage 42 opens into groove 30 at a portion at a distance from the suction-side end of the groove, which is a little greater than one pitch of the groove.

In FIG. 1, reference numeral 46 designates a discharge tube which communicates with the inside of case 10.

The following is a description of the operation of the compressor constructed in this manner.

When electric motor section 12 is energized, rotor 18 rotates, so that cylinder 20 rotates integrally therewith. At the same time, rotating rod 24 is rotated while its outer peripheral surface is partially in contact with the inner peripheral surface of cylinder 20. These relative rotatory motions of rod 24 and cylinder 20 are maintained by regulation means which includes pin 28 and engaging groove 26. Also, blade 32 rotates integrally with rod 24.

Blade 32 rotates in a manner such that its outer peripheral surface is in contact with the inner peripheral surface of cylinder 20. Therefore, each part of blade 32 is pushed into groove 30 as it approaches each contact portion between the outer peripheral surface of rod 24 and the inner peripheral surface of cylinder 20, and emerges from the groove as it goes away from the contact portion. When compression section 14 is actuated, refrigerant gas is sucked into cylinder 20 via suction tube 38 and suction hole 36. This gas is confined within operating chamber 34 which is situated at the suction-side end. As rotating rod 24 rotates, as is shown in FIGS. 6A to 6D, the gas is transferred to operating chamber 34 on the discharge side while it is confined within the space between two adjacent turns of blade 32. Since the capacities of operating chambers 34 are reduced gradually with distance from the suction side of cylinder 20, the refrigerant gas is compressed gradually as it is delivered to the discharge side. The compressed refrigerant gas is discharged into case 10 through discharge hole 40, which is formed in bearing 22*b*, and is then returned to the refrigerating cycle through discharge tube 46.

When the pressure inside case 10 increases, moreover, lubricating oil 41 is introduced into the space between blade 32 and the bottom of groove 30 via passage 44 and pressure introduction passage 42. Accordingly, blade 32 is continually urged to be pushed out from groove 30, that is, toward the inner peripheral surface of cylinder 20 by an oil pressure. During the operation of compression section 14, therefore, blade 32 can smoothly move in the radial direction of cylinder 20, without being caught by groove 30. Thus, the outer peripheral surface of blade 32 can be always kept intimately in contact with the inner peripheral surface of cylinder 20. In this manner, operating chambers 34 are separated securely by blade 32, so that the gas can be prevented from leaking from between the operating chambers.

According to the compressor constructed in this manner, groove 30 of rod 24 is formed so that its pitches gradually become narrower with distance from the suction side of cylinder 20. Thus, the capacities of operating chambers 34, which are separated by means of blade 32, are reduced gradually with distance from the suction side. Accordingly, the refrigerant gas can be compressed while it is being transferred from the suction side of cylinder 20 to the discharge side. Since the refrigerant gas is confined within operating chamber 34 when it is fed and compressed, it can be compressed highly efficiently even though no discharge valve is arranged on the discharge side of the compressor.

Since there is no need of a discharge valve, the components of the compressor can be reduced in number, so that the compressor can enjoy a simpler arrangement. Moreover, rotor 18 of electric motor section 12 is supported by cylinder 20 of compression section 14. It is unnecessary, therefore, to provide an exclusive-use rotating shaft or bearing for supporting the rotor. Thus, the number of components required can be reduced further, and the arrangement of the compressor can be made additionally simpler.

While the compressor is operating, moreover, an oil pressure is fed to the space between blade 32 and the bottom of groove 30, so that the blade is continually pressed toward the inner peripheral surface of cylinder 20. Thereupon, blade 32 rotates in a manner such that its outer peripheral surface is always intimately in contact with the inner peripheral surface of cylinder 20. Accordingly, adjacent operating chambers 34 can be securely separated to prevent gas leakage between them. In consequence, the gas can be compressed efficiently. Pressed toward the inner peripheral surface of cylinder 20, moreover, blade 32 can smoothly move in groove 30 in the radial direction of the cylinder, tracing the inner peripheral surface thereof, even though the working accuracy of the components, such as the rectangularity of the blade, is not very high. Thus, the manufacture and assembling of the components can be facilitated.

Lubrication and sealing between the inner peripheral surface of groove 30 and blade 32 can be effected by feeding high-pressure lubricating oil into the space between blade 32 and the bottom of groove 30. Since this interposal space extends spirally along groove 30, it serves as a hydraulic pump which can supply the lubricating oil to other sliding portions.

Cylinder 20 and rotating rod 24 are in contact with each other while they rotate in the same direction. Therefore, the friction between these two members is so small that they can rotate smoothly with less vibrations and noises.

The feeding capacity of the compressor depends on the first pitch of blade 32, that is, the capacity of operating chamber 34 which is situated at the suction-side end of cylinder 20. In the present embodiment, the pitches of blade 32 gradually become narrower with distance from the suction side of cylinder 20. If the number of turns of blade 32 is fixed, therefore, the first pitch of the blade and hence, the feeding capacity of the compressor, according to this embodiment, can be made greater than those of a compressor whose blade has regular pitches throughout the length of its rotating rod. In other words, a high-efficiency compressor can be obtained.

If the number of turns of blade 32 is increased although the feeding capacity is reduced, then the difference in pressure between each two adjacent operating chambers decreases in inverse proportion. Thus, the amount of gas leak between the operating chambers is reduced, so that the compression efficiency is improved.

Figure 8:
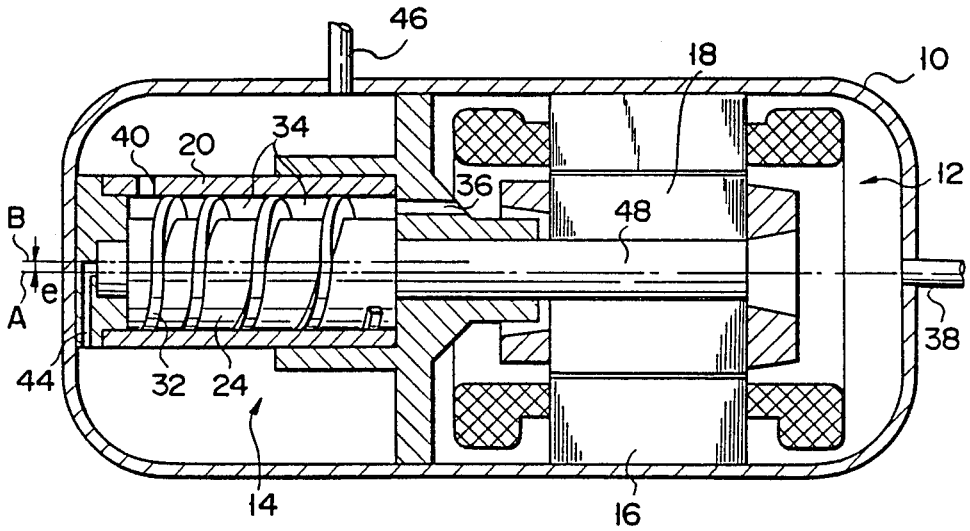
FIG. 8 is a sectional view of a compressor according to another embodiment of the present invention.
Figure 6A:
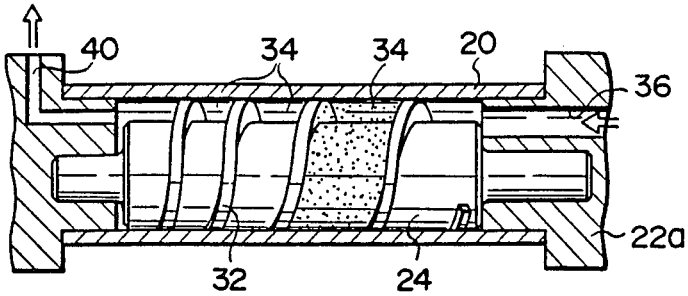
Figure 6B:
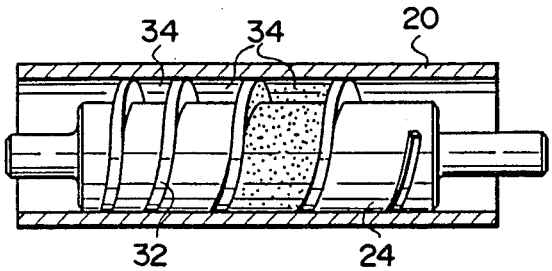
Figure 6C:
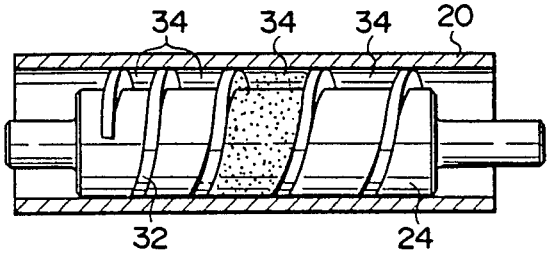
Figure 6D:
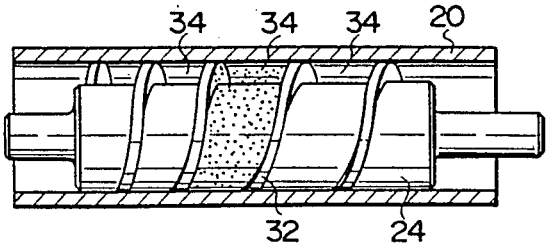

FIG. 8 shows a compressor according to a second embodiment of the present invention.

According to this embodiment, electric motor section 12 and compression section 14 are arranged horizontally in case 10. Bearing 22*a* is located in the central portion of case 10 so that the inside space of the case is divided airtightly into two compartments for sections 12 and 14 by bearing 22*a*. Rotating shaft 48, extending horizontally, is rotatably supported by bearing 22*a*. Rotor 18 of motor section 12 is coaxially fixed to the right end portion of shaft 48 and situated inside stator 16.

The right end of rotating rod 24 is coaxially fixed to the left end of rotating shaft 48. The left end of rod 24 is rotatably supported by bearing 22*b*, which is fixed to the inner surface of case 10. As in the case of the first embodiment, rod 24 is formed, on its outer peripheral surface, with a spiral groove whose pitches gradually become narrower with distance from the right end of the rod. Spiral blade 32 is fitted in this groove. Outside rod 24, cylinder 20 extends along its axis. Two opposite ends of cylinder 20 are rotatably supported by bearings 22*a* and 22*b*, individually. Central axis B of cylinder 20 is situated at eccentricity e from central axis A of rod 24.

Bearing 22*a* is formed with suction hole 36 which opens into the right or suction-side end portion of cylinder 20. In this embodiment, discharge hole 40 is formed at the discharge-side end portion of cylinder 20 so as to connect the respective inside spaces of the cylinder and case 10. When the pressure inside case 10 increases, high-pressure gas therein, instead of lubricating oil, is introduced directly into the space between blade 32 and the bottom of groove 30 via passage 44 and a pressure introduction passage which is formed in rod 24.

The second embodiment shares other arrangements with the first embodiment, and like reference numerals are used to designate like portions throughout the drawings for simplicity of illustration.

Constructed in this manner, the compressor according to the second embodiment, like the one according to the first embodiment, can efficiently compress gas, and permits simplification of arrangement.

It is to be understood that the present invention is not limited to the embodiments described above, and that various changes and modifications may be effected therein by one skilled in the art without departing from the scope or spirit of the invention. For example, the invention may be also applied to compressors of many other types than those used in refrigeration cycles. Further, the compressors of the present invention are not limited to the type in which a compression section and an electric motor section are contained in a closed case, and may be of the so-called open type in which pipes are directly coupled to a suction hole and a discharge hole, respectively.

What is claimed is:

1. A fluid compressor comprising:

a cylinder having a suction-side end and a discharge-side end;

a columnar rotating body located in the cylinder so as to extend along the axial direction of the cylinder and be eccentric thereto, and rotatable relative to the cylinder while part of said rotating body is in contact with the inner peripheral surface of the cylinder, said rotating body having a spiral groove on the outer peripheral surface thereof, said groove having pitches gradually narrowing with distance from the suction-side end of the cylinder;

a spiral blade fitted in the groove so as to be slidable, substantially in the radial direction of the rotating body, having an outer peripheral surface intimately in contact with the inner peripheral surface of the cylinder, and dividing the space between the inner peripheral surface of the cylinder and the outer peripheral surface of the rotating body into a plurality of operating chambers having volumes gradually decreasing with distance from the suction-side end of the cylinder; and drive means for relatively rotating the cylinder and the rotating body to successively transport a fluid introduced from the suction-side end of the cylinder into the cylinder toward the the discharge-side end of the cylinder through the operating chambers.

2. A compressor according to claim 1, which further comprises pressurizing means for pressurizing the space between the blade and the bottom of the groove so as to press the blade toward the inner peripheral surface of the cylinder.

3. A compressor according to claim 2, wherein said pressurizing means includes means for supplying pressurized oil into the space between the blade and the bottom of the groove.

4. A compressor according to claim 3, wherein said supply means includes an oil pressure introduction passage formed in the rotating body and guide means for introducing the pressurized oil into the oil pressure introduction passage, said oil pressure introduction passage having one end opening to one end of the rotating body and the other end opening to the bottom of the groove.

5. A compressor according to claim 4, which further comprises a closed case, containing the drive means and the cylinder, and means for discharging the fluid transported to the discharge-side end of the cylinder into the closed case; and wherein said supply means has lubricating oil stored in a bottom portion of the closed case, and said guide means includes a guide passage having one end communicating with the one end of the oil pressure introduction passage and the other end opening into the lubricating oil.

6. A compressor according to claim 2, wherein said pressurizing means includes means for supplying high-pressure gas into the space between the blade and the bottom of the groove.

7. A compressor according to claim 6, wherein said supply means includes a pressure introduction passage formed in the rotating body and guide means for introducing some of the fluid transported to the operating chamber at the discharge-side end of the cylinder by the drive means into the pressure introduction passage, said pressure introduction passage having one end opening to one end of the rotating body and the other end opening to the bottom of the groove.

8. A compressor according to claim 7, which further comprises a closed case, containing the drive means and the cylinder, and means for discharging the fluid transported to the discharge-side end of the cylinder into the closed case; and wherein said guide means includes a guide passage, having one end communicating with the one end of the pressure introduction passage and the other end opening into the closed case, for introducing some of the fluid which discharged into the closed case into the pressure introduction passage.

9. A compressor according to claim 1, wherein said drive means includes an electric motor section for rotating the cylinder, and means for transmitting the rotatory force of the cylinder to the rotating body so as to rotate the rotating body in synchronism with the cylinder.

10. A compressor according to claim 9, wherein said electric motor section includes a rotor fixed to the outer peripheral surface of the cylinder and a stator disposed outside the rotor.

11. A compressor according to claim 10, which further comprises first and second bearings rotatably supporting the suction- and discharge-side ends of the cylinder, respectively; and wherein said rotating body has a pair of end portions rotatably supported by the first and second bearings, respectively.

12. A compressor according to claim 11, which further comprises a closed case containing the cylinder, the electric motor section, and the first and second bearings; a suction hole having one end opening into the inside of the suction-side end portion of the cylinder and the other end opening to the outside of the closed case; and a discharge hole having one end opening into the inside of the discharge-side end portion of the cylinder and the other end opening into the inside of the closed case.

13. A compressor according to claim 12, wherein said suction hole is formed in the first bearing.

14. A compressor according to claim 12, wherein said discharge hole is formed in the second bearing.

15. A compressor according to claim 12, wherein said discharge hole is formed in the cylinder.

16. A compressor according to claim 9, wherein said transmission means includes an engaging groove, formed on the outer peripheral surface of the rotating body, and a projecting portion protruding from the inner peripheral surface of the cylinder and fitted in the engaging groove so as to be movable in the radial direction of the cylinder.

17. A compressor according to claim 1, wherein said drive means includes a rotating shaft coaxially coupled to the rotating body and an electric motor section for rotating the rotating shaft.

* * * * *